US007621224B2

(12) United States Patent
Lin et al.

(10) Patent No.: US 7,621,224 B2
(45) Date of Patent: Nov. 24, 2009

(54) BLOW-MOLDED TABLE

(75) Inventors: Wen-Sheng Lin, Kaohsiung (TW); Hsin-Hung Tsai, Jhuci Township, Chiayi County (TW)

(73) Assignee: Maxchief Investments Limited (CN)

( * ) Notice: Subject to any disclaimer, the term of this patent is extended or adjusted under 35 U.S.C. 154(b) by 460 days.

(21) Appl. No.: 11/423,547

(22) Filed: Jun. 12, 2006

(65) Prior Publication Data

US 2006/0219138 A1 Oct. 5, 2006

Related U.S. Application Data

(63) Continuation-in-part of application No. 10/763,151, filed on Jan. 21, 2004, now Pat. No. 7,150,237, and a continuation-in-part of application No. 10/763,155, filed on Jan. 21, 2004, now abandoned, and a continuation-in-part of application No. 10/763,154, filed on Jan. 21, 2004, now abandoned.

(51) Int. Cl.
*A47B 3/00* (2006.01)

(52) U.S. Cl. ..... 108/132; 108/115

(58) Field of Classification Search ..... 108/115–135; 248/188.1, 188.6
See application file for complete search history.

(56) References Cited

U.S. PATENT DOCUMENTS 1,446,924 A * 2/1923 Nicholson ..... 403/85
1,560,913 A 11/1925 Johnson
1,905,219 A 4/1933 Crichton
1,959,725 A 5/1934 Lindsay
2,643,926 A 6/1953 Pucci
3,064,846 A * 11/1962 Thomas ..... 217/60 G
3,368,504 A 2/1968 Cohen
3,464,373 A * 9/1969 Larson ..... 108/125
5,279,233 A 1/1994 Cox
5,357,872 A 10/1994 Wilmore
5,509,361 A * 4/1996 Chen ..... 108/131
6,058,853 A * 5/2000 Pinch ..... 108/129
6,371,034 B1 * 4/2002 Simpson et al. ..... 108/129
6,520,094 B2 2/2003 Wen
6,550,404 B2 4/2003 Stanford
6,622,644 B2 9/2003 Buono
6,659,021 B2 12/2003 Wen
6,666,152 B2 * 12/2003 Tsai ..... 108/129
6,823,806 B1 11/2004 Buono
2002/0092445 A1 7/2002 Glover et al.
2003/0167981 A1 * 9/2003 Cai ..... 108/132
2003/0233968 A1 12/2003 Strong et al.
2004/0031422 A1 2/2004 Wong
2004/0244656 A1 12/2004 Shenghao et al.
2005/0155531 A1 * 7/2005 Chang ..... 108/130
2005/0155532 A1 * 7/2005 Lin et al. ..... 108/132
2005/0160952 A1 * 7/2005 Tsai ..... 108/169
2005/0279260 A1 12/2005 Stanford et al.

* cited by examiner

*Primary Examiner*—Janet M Wilkens
*Assistant Examiner*—Timothy M Ayres
(74) *Attorney, Agent, or Firm*—Luedeka, Neely & Graham, P.C.

(57) ABSTRACT

A collapsible table includes a blow-molded table top and two opposing collapsible support stands mounted on a bottom of the table top. The support stands are supported by articulated support braces attached to cross braces that span the underside of the table top. At opposing ends of the cross braces are substantially U-shaped brackets that receive leg members of the support stands when the support stands are in a collapsed position.

5 Claims, 21 Drawing Sheets

BLOW-MOLDED TABLE

This application claims priority as a continuation-in-part to U.S. patent application Ser. No. 10/763,151 titled BLOW-MOLDED TABLE which issued as U.S. Pat. No. 7,150,237 on Dec. 19, 2006, Ser. No. 10/763,155 titled FOLDABLE TABLE which is now abandoned, and Ser. No. 10/763,154 titled CIRCULAR TABLE which is now abandoned, all filed Jan. 21, 2004.

FIELD

The present invention relates to a blow-molded table, and more particularly to a blow-molded table that is expanded easily and rapidly and is folded easily when not in use, thereby enhancing the versatility of the blow-molded table.

BACKGROUND AND SUMMARY

A conventional table is available for providing a support effect, thereby facilitating the user using the table. However, the conventional table has a fixed structure and cannot be folded when not in use, thereby increasing space of storage, and thereby causing inconvenience in storage, package and transportation.

The primary objective of the present invention is to provide a blow-molded table that is supported rigidly and stably when being expanded and is folded when not in use, thereby enhancing the versatility of the blow-molded table.

Another objective of the present invention is to provide a blow-molded table, wherein the two support units are expanded outward rapidly to support the table board rigidly and stably, thereby facilitating the user expanding the blow-molded table.

A further objective of the present invention is to provide a blow-molded table, wherein the support units are folded in the receiving space of the table board to fold the blow-molded table when not in use, thereby saving space of storage, package and transportation.

In accordance with the present invention, there is provided a blow-molded table, comprising a table board, and two opposite support units each foldably mounted on a bottom of the table board, wherein the bottom of the table board is formed with a receiving space, and each of the two support units is mounted in the receiving space of the table board and includes a support stand pivotally mounted on either one of two ends of the table board, and a support member pivotally mounted on a mediate of the table board and pivotally connected with the support stand.

In a preferred embodiment, the invention provides a collapsible table having a blow-molded table top, a pair of substantially parallel frame members and a pair of opposing support stands pivotally attached to and between the frame members. The table top has an upper surface, a lower surface and a downwardly extending lip structure disposed about an outer perimeter of the table top. The frame members are attached adjacent the lip structure and the lower surface of the table top. The support stands are operable to be positioned in an upright position in which the support stands are disposed substantially perpendicular to the tower surface of the table top and in a collapsed position in which the support stands are disposed substantially parallel to the lower surface of the table top. The table includes a plurality of fasteners for fastening the frame members to the table top. In preferred embodiments, the fasteners pass through at least a portion of each frame member and engage the lower surface of the table top but do not engage the lip structure.

In another preferred embodiment, the invention provides a collapsible table comprising a blow-molded table top, a pair of substantially parallel frame members attached on opposing sides of the table top, first and second support stands, first and second cross braces and first and second support braces. The first and second support stands are pivotally attached to and between the frame members so they may be positioned in an upright position and a collapsed position. In the upright position, the support stands are disposed substantially perpendicular to the lower surface of the table top. In the collapsed position, they are disposed substantially parallel to the lower surface of the table top. Each support stand comprises a pair of leg members.

The first cross brace includes a central elongate section disposed between first and second ends that are pivotally connected to a corresponding one of the opposing frame members. Disposed adjacent the first end of the first cross brace is a first substantially U-shaped bracket, and disposed adjacent the second end of the first cross brace is a second substantially U-shaped bracket. The first and second U-shaped brackets receive at least one of the leg members when at least one of the first and second support stands are in the collapsed position. The second cross brace includes a central elongate section disposed between first and second ends that are pivotally connected to a corresponding one of the opposing frame members. A third substantially U-shaped bracket is disposed adjacent the first end of the second cross brace, and a fourth substantially U-shaped bracket is disposed adjacent the second end of the second cross brace. The third and fourth U-shaped brackets also receive at least one of the leg members when at least one of the first and second support stands are in the collapsed position.

The first support brace has a first end that is pivotally connected to the first support stand and a second end that is connected to the central elongate section of the first cross brace. The first support brace has an articulated joint disposed between its first and second ends whereby the first support brace is extended when the first support stand is in the upright position and the first support brace is folded when the first support stand is in the collapsed position. The second support brace has a first end pivotally connected to the second support stand and a second end connected to the central elongate section of the second cross brace. The second support brace has an articulated joint disposed between its first and second ends whereby the second support brace is extended when the second support stand is in the upright position and the second support brace is folded when the second support stand is in the collapsed position.

In another preferred embodiment, the invention provides a collapsible table comprising a blow-molded table top, a pair of substantially parallel frame members attached on opposing sides of the table top, first and second support stands, and first., second, third and fourth articulated support braces for bracing the support stands when they are in an upright position. The support stands, which are pivotally attached to and between the frame members, are operable to be positioned in the upright position and a collapsed position. In the upright position, the support stands are disposed substantially perpendicular to the lower surface of the table top. In the collapsed position, the support stands are disposed substantially parallel to the lower surface of the table top. The first and second support stands each include opposing first and second leg members.

The first articulated support brace has an inner section pivotally connected to the first leg member of the first support stand and an outer section pivotally connected to an adjacent one of the frame members. The second articulated support brace has an inner section pivotally connected to the second leg member of the first support stand and an outer section pivotally connected to an adjacent one of the frame members. An articulated joint is disposed between the inner and outer sections of the first and second support braces so that the first and second support braces may be extended when the first support stand is in the upright position and folded when the first support stand is in the collapsed position.

Similarly, the third articulated support brace has an inner section pivotally connected to the first leg member of the second support stand and an outer section pivotally connected to an adjacent one of the frame members. The fourth articulated support brace has an inner section pivotally connected to the second leg member of the second support stand and an outer section pivotally connected to an adjacent one of the frame members. An articulated joint is disposed between the inner and outer sections of the third and fourth support braces so that the third and fourth support braces may be extended when the second support stand is in the upright position and folded when the second support stand is in the collapsed position.

The inner section of each of the articulated support braces includes a lower portion that is pivotally connected to the corresponding leg member, an upper portion having an aperture disposed at the articulated joint, and a dogleg portion disposed between the lower portion and the upper portion. The outer section of each of the articulated support braces comprises a single elongate piece of sheet metal folded to form an outer flange disposed on an outer side of the fold and a lower inner flange disposed on an inner side of the fold. The outer flange has an aperture disposed at the articulated joint, and the lower inner flange has an aperture substantially aligned with the second aperture in the outer flange. The upper portion of the inner section of each of the articulated support braces is sandwiched between the outer flange and the lower inner flange of the outer section. The aperture in the upper portion is substantially aligned with the aperture in the outer flange and the aperture in the lower inner flange. The articulated joint of each of the support braces includes a pivot fastener passing through the three apertures to pivotally connect the inner section of the brace to the outer section.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
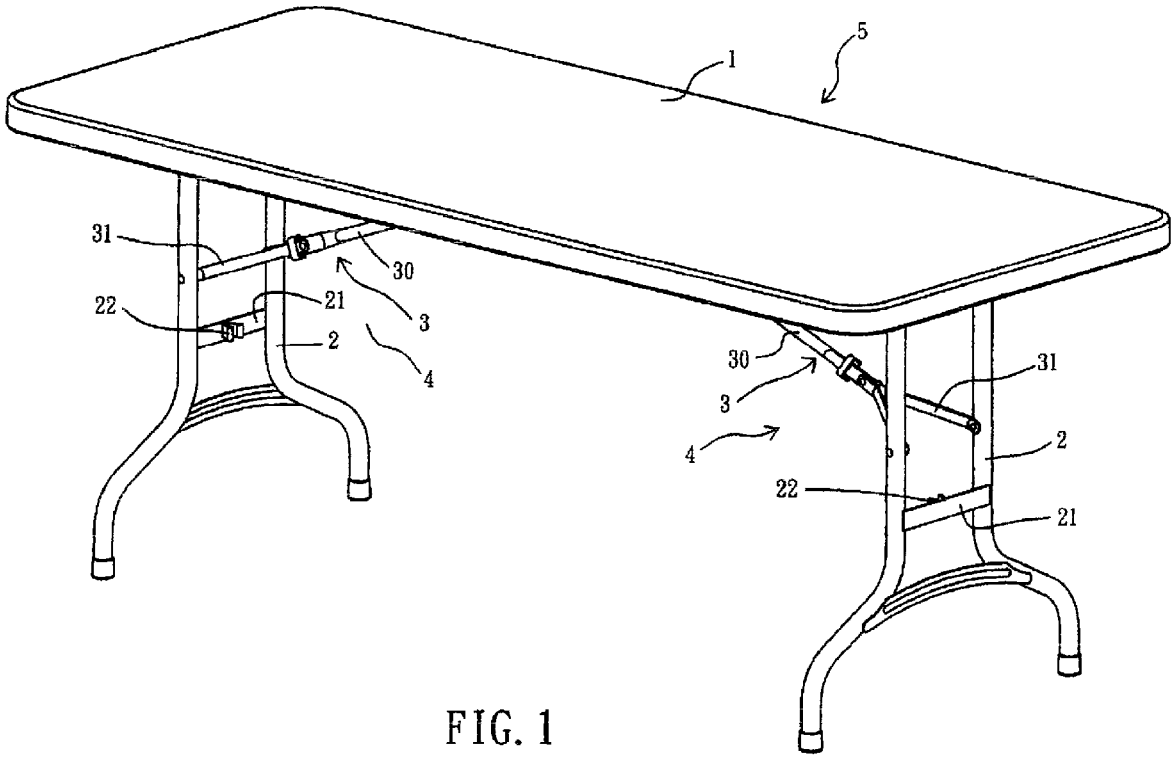
FIG. 1 is a perspective view of a blow-molded table in accordance with a preferred embodiment of the present invention.

Referring to the drawings and initially to FIGS. 1-7, a blow-molded table 5 in accordance with the preferred embodiment of the present invention comprises a table board 1, and two opposite support units 4 each foldably mounted on a bottom of the table board 1.

Figure 5:
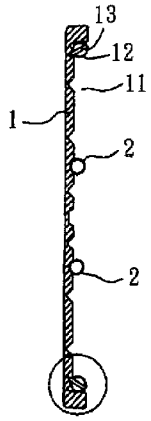
FIG. 5 is a plan cross-sectional view of the blow-molded table taken along line 5-5 as shown in FIG. 4.
Figure 6:
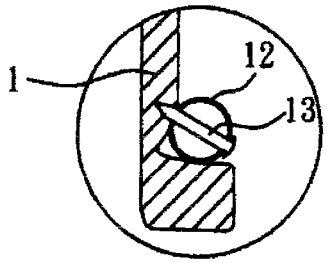
FIG. 6 is a partially enlarged view of the blow-molded table as shown in FIG. 5.
Figure 7:
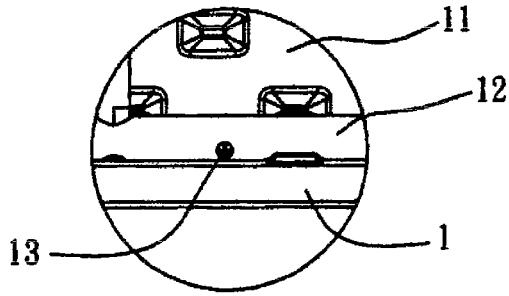
FIG. 7 is a partially enlarged view of the blow-molded table as shown in FIG. 4.

The bottom of the table board 1 is formed with a receiving space 11. The receiving space 11 of the table board 1 has two opposite sides each provided with a support tube 12 which is secured on the table board 1 by a plurality of screws 13 as shown in FIGS. 5-7.

Each of the two support units 4 is mounted in the receiving space 11 of the table board 1 and includes a support stand 2 pivotally mounted on one of two ends of the table board 1, and a support member 3 pivotally mounted on a mediate of the table board 1 and pivotally connected with the support stand 2.

The support stand 2 of each of the two support units 4 is provided with an auxiliary reinforcement member 21 having a mediate portion formed with a substantially C-shaped holder 22. The support stands 2 of the two support units 4 are in alignment with each other as shown in FIG. 3.

The support member 3 of each of the support units 4 includes a substantially T-shaped support bar 30 having a first end pivotally mounted on the mediate portion of the table board 1, and a substantially V-shaped extension bar 3 1 having a first end pivotally mounted on a second end of the support bar 30 and a second end pivotally mounted on the support stand 2. The support bars 30 of the two support units 4 are juxtaposed to each other as shown in FIG. 2.

The receiving space 11 of the table board 1 is formed with a plurality of receiving recesses 14 for receiving the support stand 2 and the support member 3 of each of the support units 4 when being folded.

Figure 2:
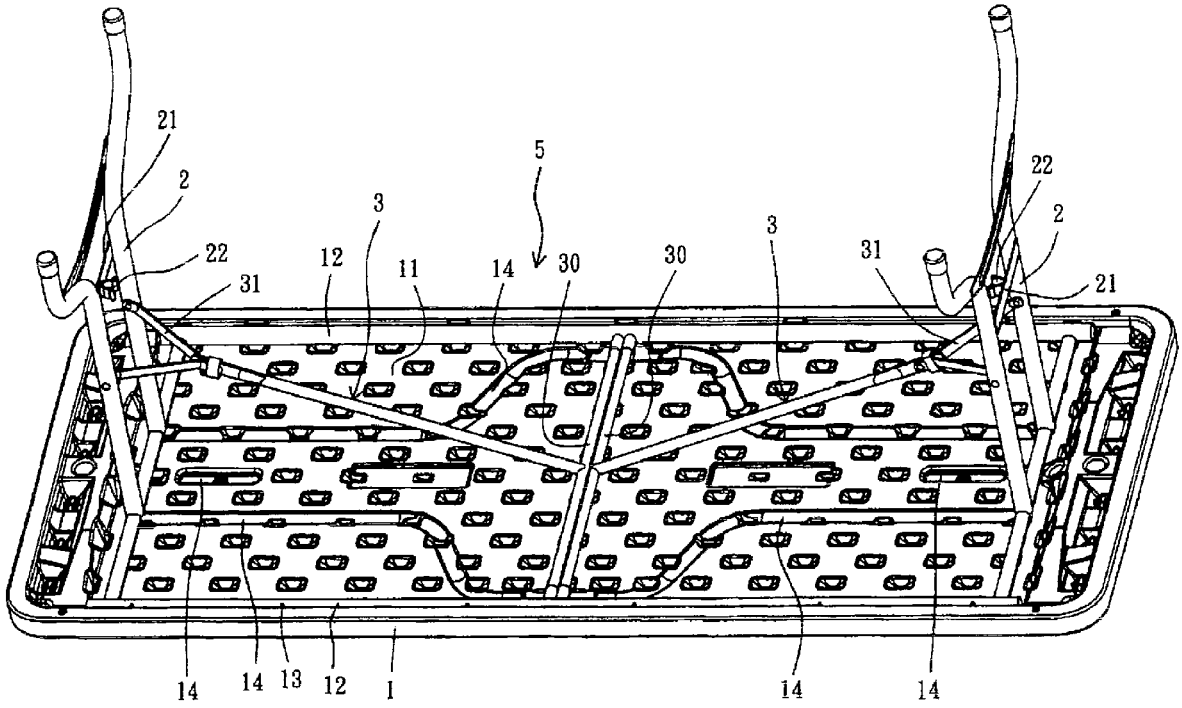
FIG. 2 is a bottom perspective view of the blow-molded table as shown in FIG. 1.
Figure 3:
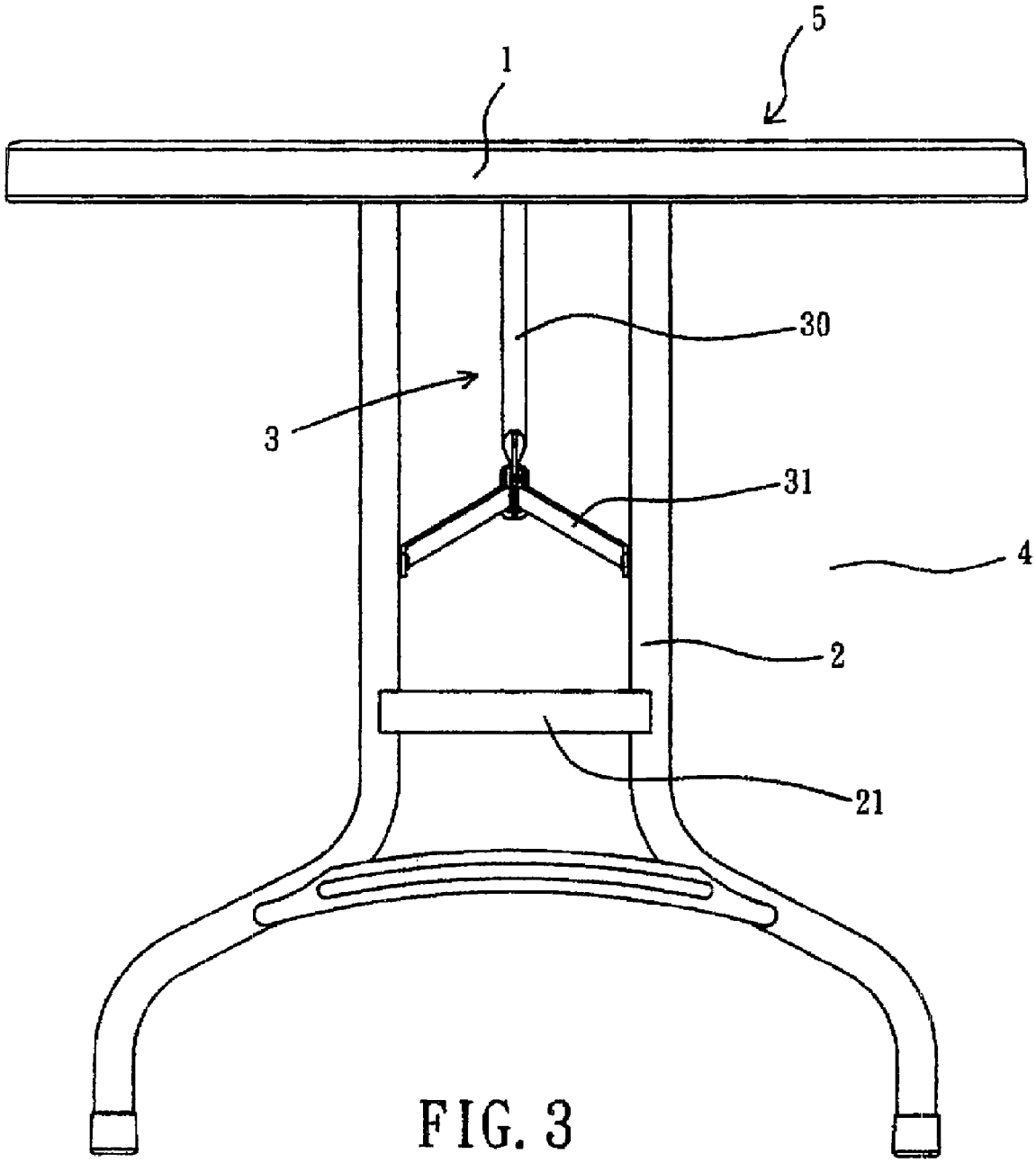
FIG. 3 is a side plan view of the blow-molded table as shown in FIG. 1.

In practice, as shown in FIGS. 1-3, the support stand 2 of each of the support units 4 is pulled outward relative to the table board 1 to drive the support member 3 to extend outward, thereby fully stretching the support member 3, so that the table board 1 is supported by the two support units 4 rigidly and stably, thereby fully expanding the blow-molded table 5 as shown in FIG. 1.

Figure 4:
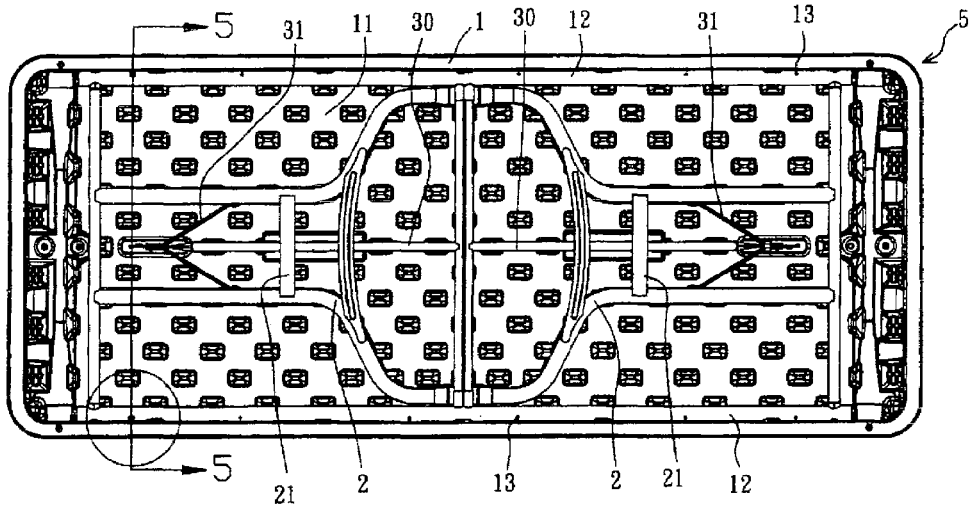
FIG. 4 is a bottom plan folded view of the blow-molded table as shown in FIG. 1.

As shown in FIGS. 4-7, when the user wishes to fold the blow-molded table 5, the support stand 2 of each of the support units 4 is pressed toward the table board 1 to drive the extension bar 31 and the support bar 30 of the support member 3 to move and pivot inward, thereby moving and folding the support member 3 and the support stand 2 into the receiving recesses 14 of the table board 1, so that the support units 4 are folded in the receiving space 11 of the table board 1, thereby folding the blow-molded table 5 as shown in FIG. 4. When the support member 3 and the support stand 2 are folded, the holder 22 of the support stand 2 is clamped on the support bar 30 of the support member 3, so that the support member 3 is combined with the support stand 2.

Accordingly, the two support units 4 are expanded outward rapidly to support the table board 1 rigidly and stably, thereby facilitating the user expanding the blow-molded table 5. In addition, the support units 4 are folded in the receiving space 11 of the table board 1 to fold the blow-molded table 5 when not in use, thereby saving space of storage, package and transportation.

Figure 8:
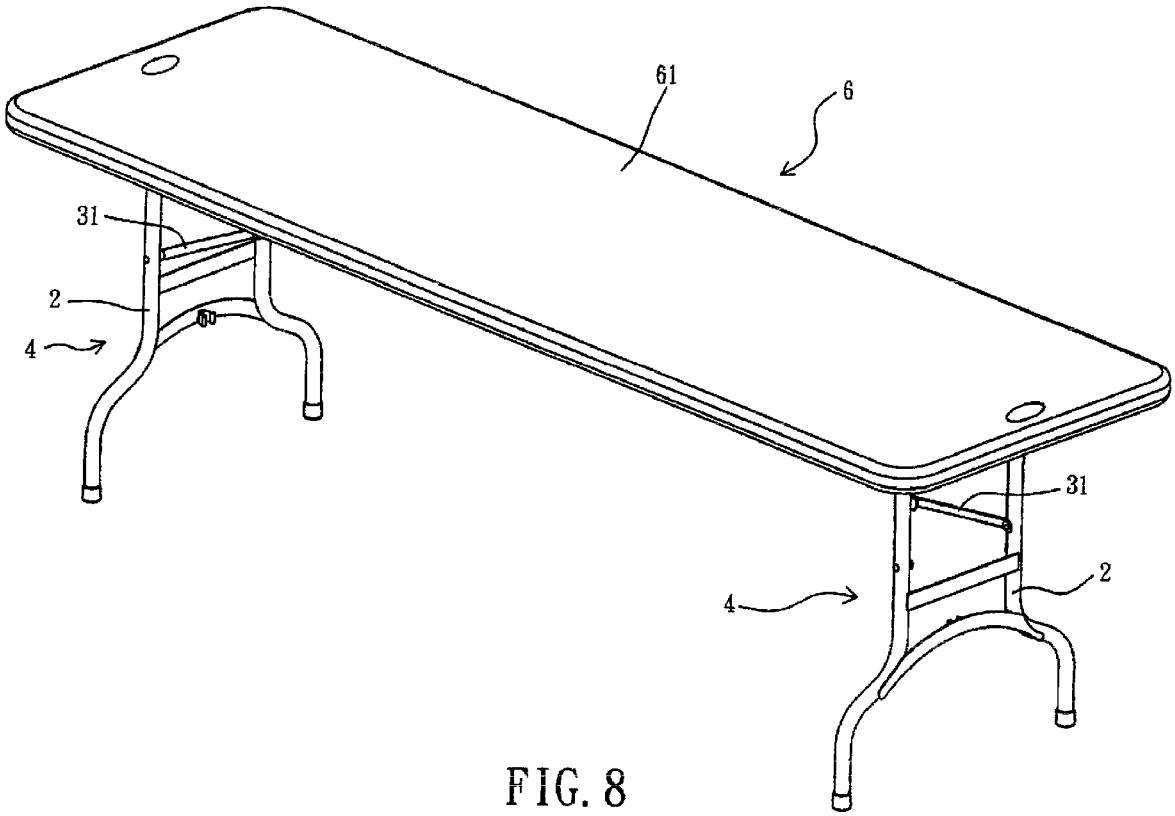
FIG. 8 is a perspective view of a blow-molded table in accordance with another embodiment of the present invention.
Figure 9:
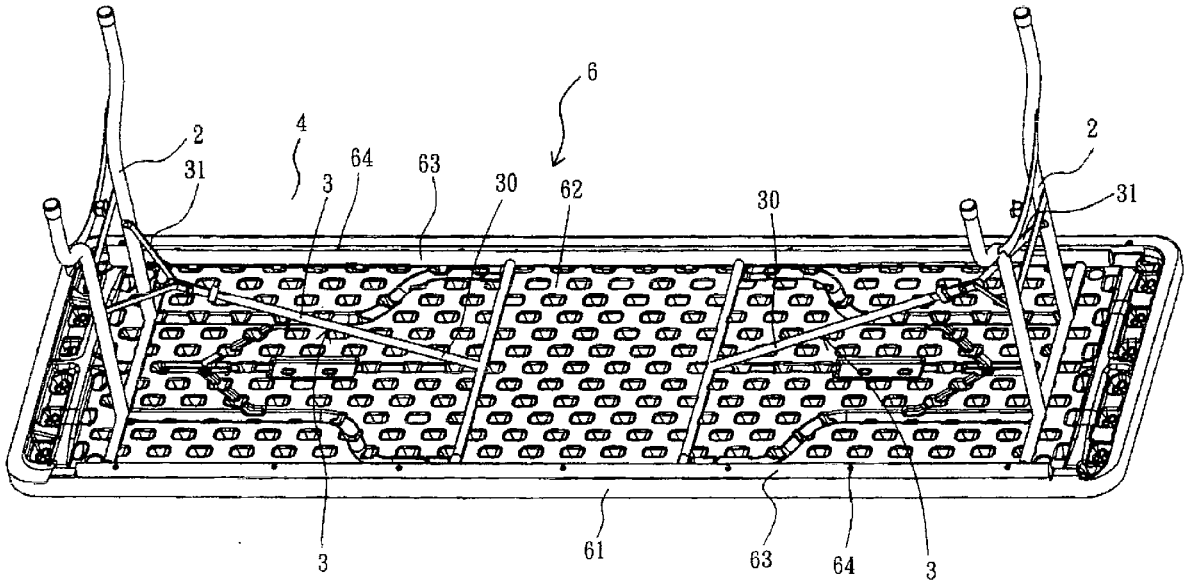
FIG. 9 is a bottom perspective view of the blow-molded table as shown in FIG. 8.
Figure 10:
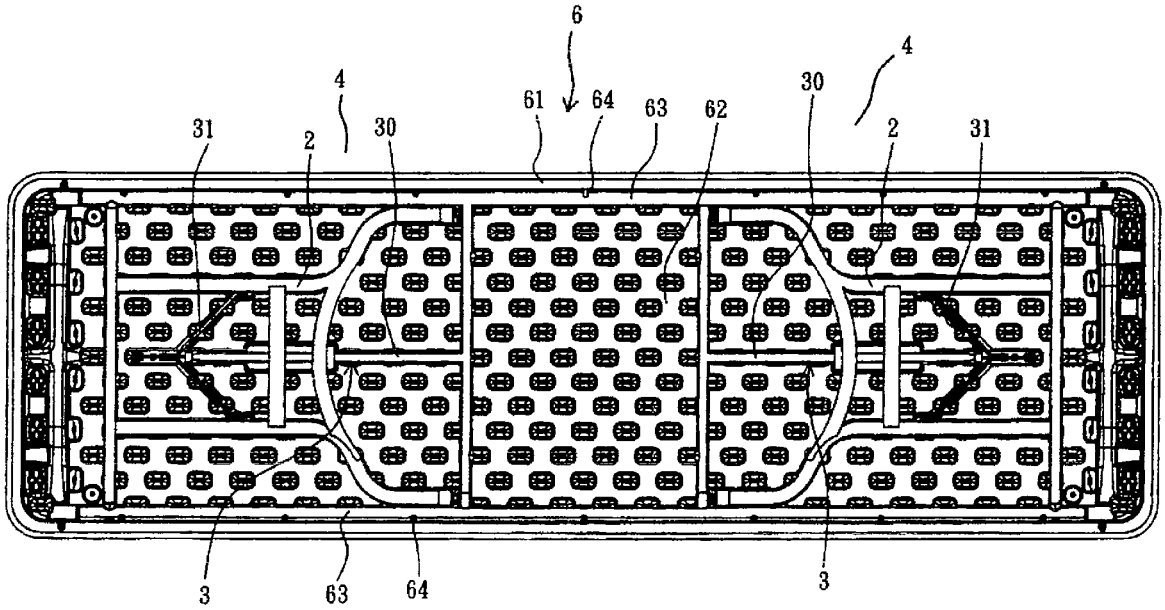
FIG. 10 is a bottom plan folded view of the blow-molded table as shown in FIG. 8.

Referring to FIGS. 8-10, a blow-molded table 6 in accordance with another embodiment of the present invention is shown, wherein the table board 61 has a length greater than that of the table board 1. The bottom of the table board 61 is formed with a receiving space 62. The receiving space 62 of the table board 61 has two opposite sides each provided with a support tube 63 which is secured on the table board 61 by a plurality of screws 64. In such a manner, the support bars 30 of the two support units 4 are spaced from each other as shown in FIG. 9.

Figure 11:
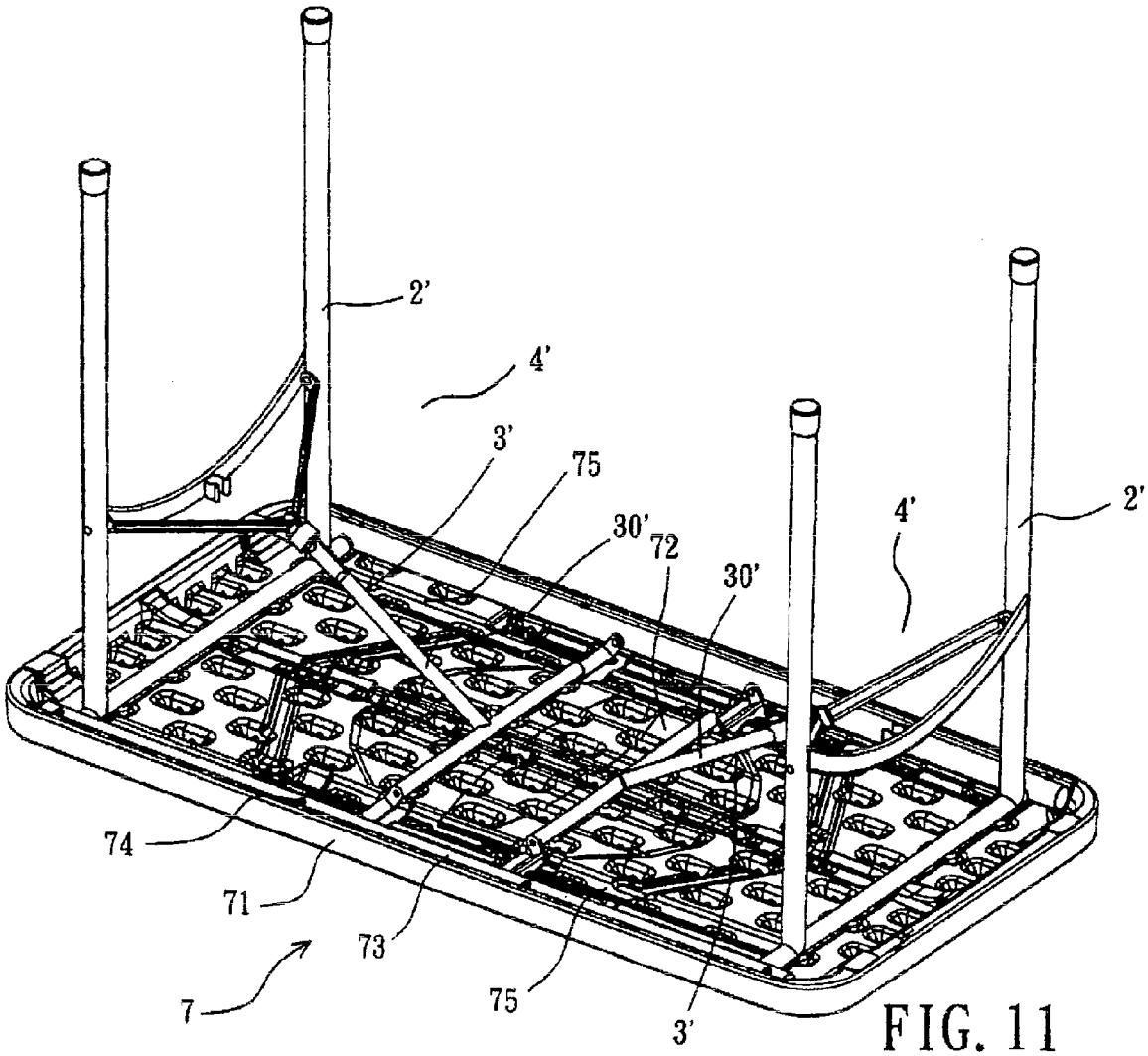
FIG. 11 is a bottom perspective view of a blow-molded table in accordance with another embodiment of the present invention.
Figure 12:
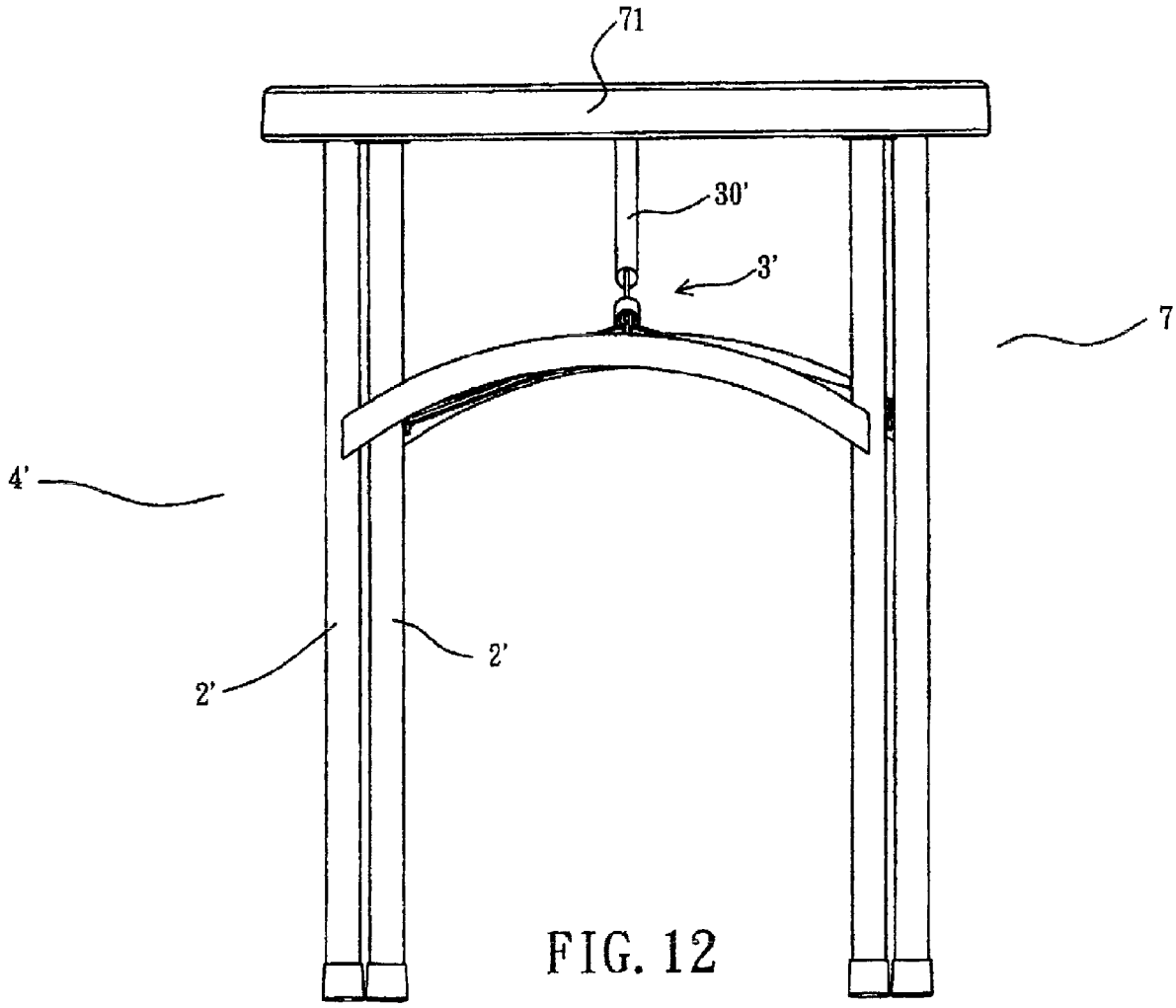
FIG. 12 is a side plan view of the blow-molded table as shown in FIG. 11.
Figure 13:
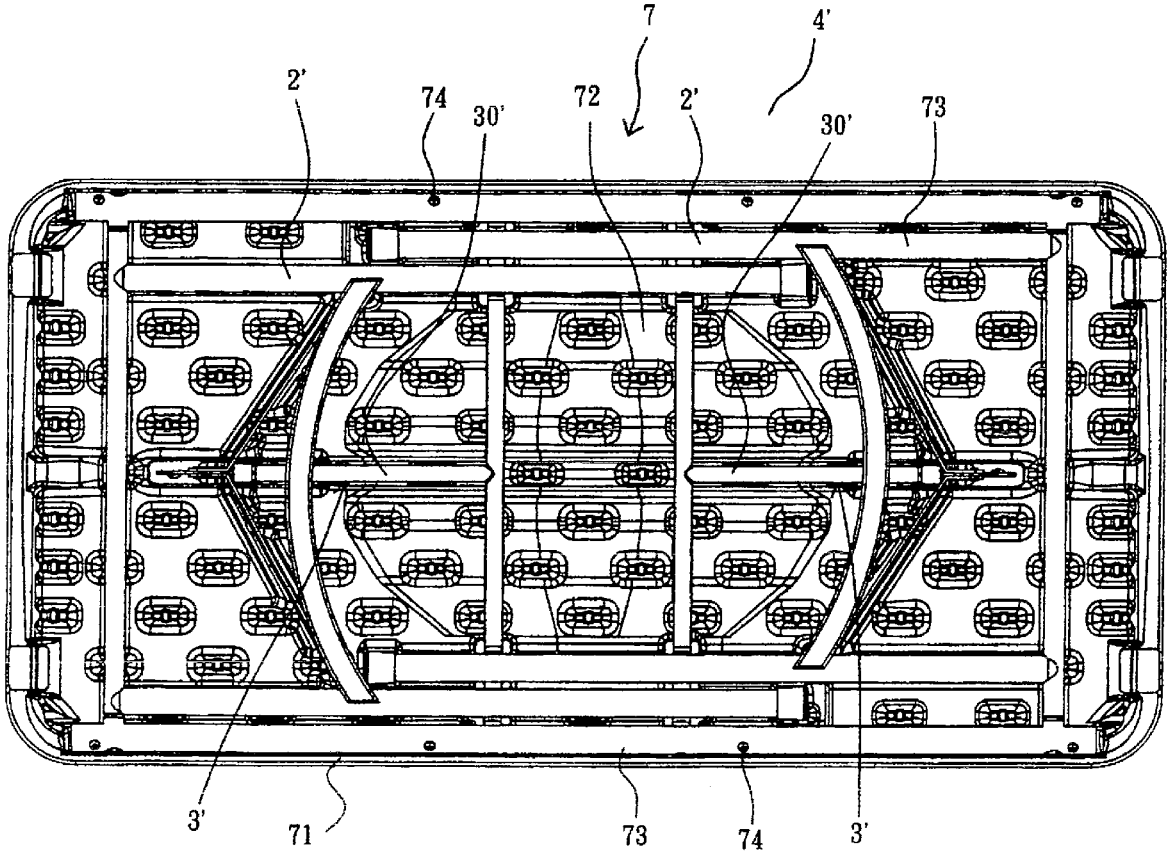
FIG. 13 is a plan folded view of the blow-molded table as shown in FIG. 11.

Referring to FIGS. 11-13, a blow-molded table 7 in accordance with another embodiment of the present invention is shown, wherein the table board 71 has a length smaller than that of the table board 1. The bottom of the table board 71 is formed with a receiving space 72. The receiving space 72 of the table board 71 has two opposite sides each provided with a support tube 73 which is secured on the table board 71 by a plurality of screws 74. The receiving space 72 of the table board 71 is formed with a plurality of receiving recesses 75 for receiving the support stand 2' and the support member 3' of each of the support units 4' when being folded. In such a manner, the support bars 30' of the two support members 3' are spaced from each other as shown in FIG. 11, and the support stands 2' of the two support units 4' are arranged in a in a staggered manner as shown in FIGS. 12 and 13.

Figure 14:
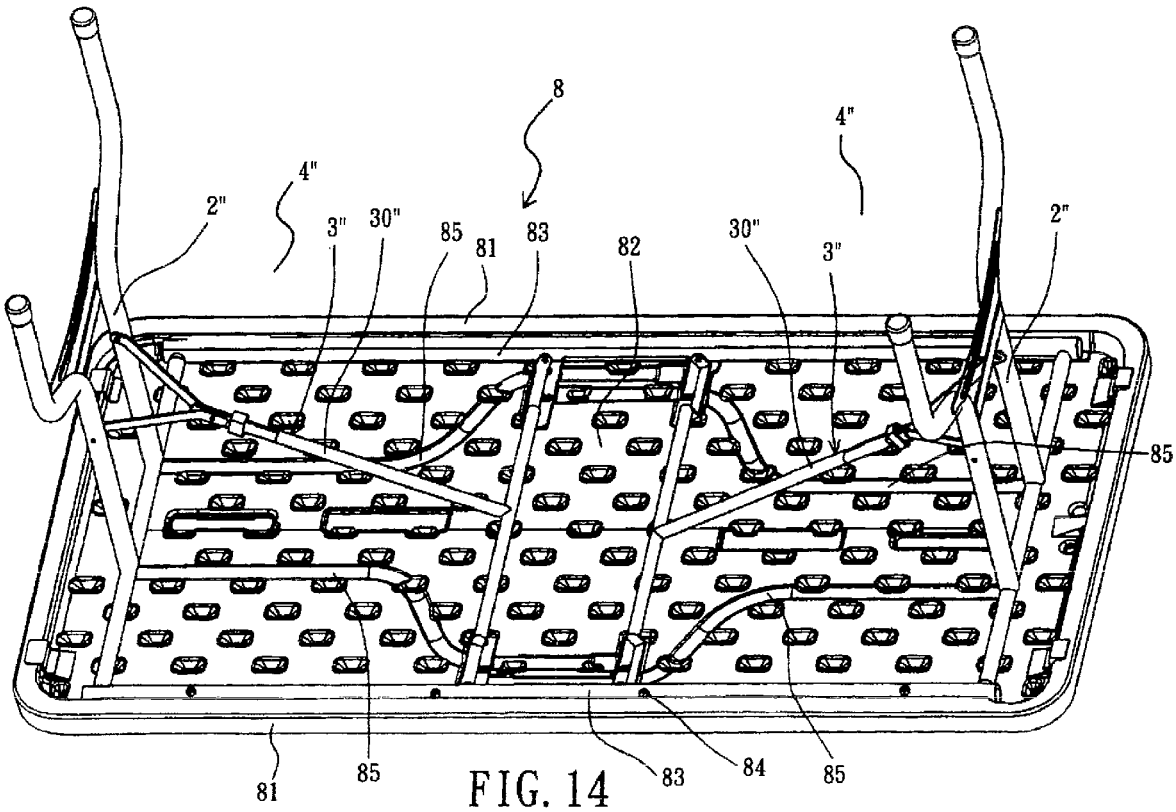
FIG. 14 is a bottom perspective view of a blow-molded table in accordance with another embodiment of the present invention.
Figure 15:
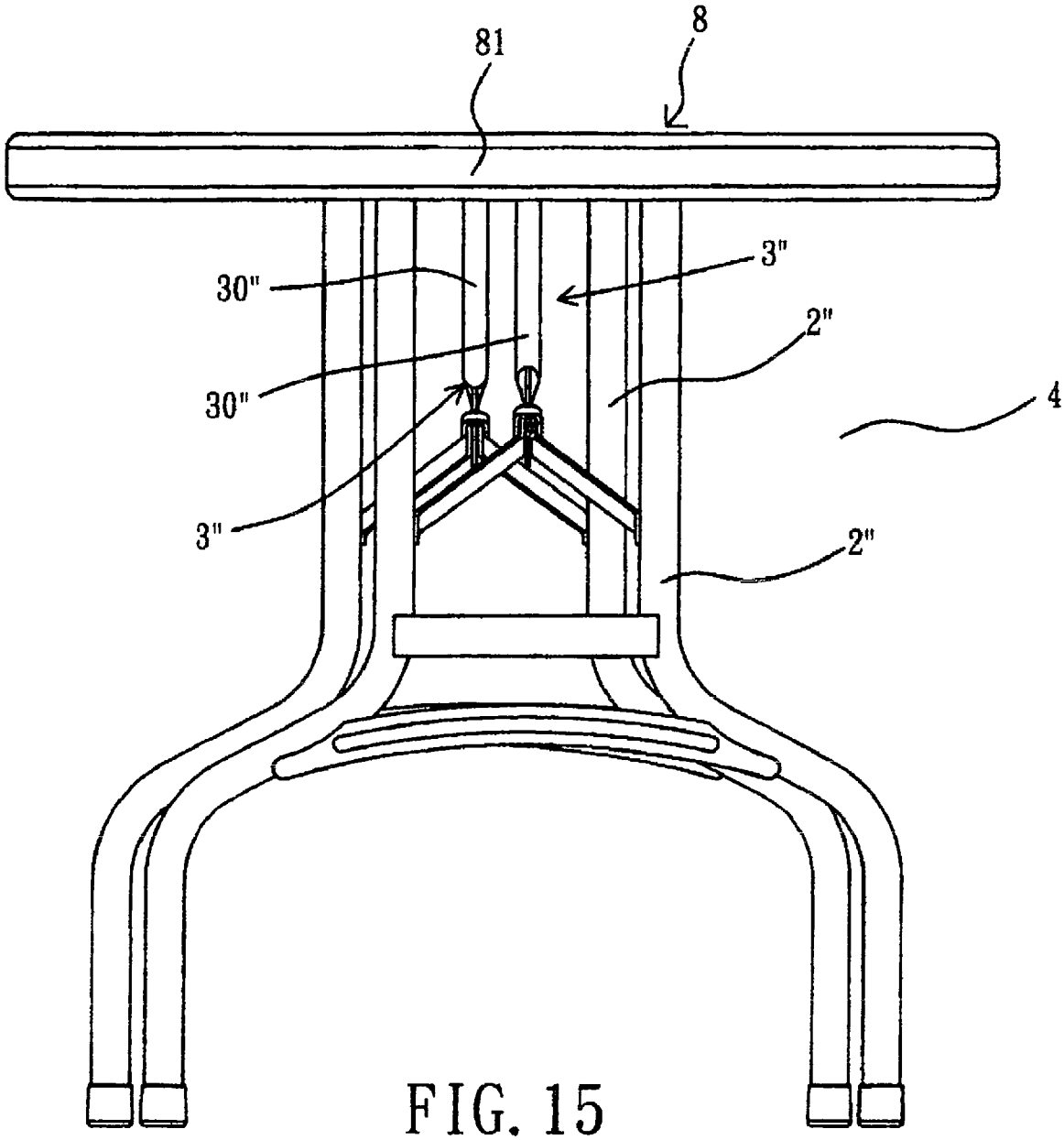
FIG. 15 is a side plan view of the blow-molded table as shown in FIG. 14.
Figure 16:
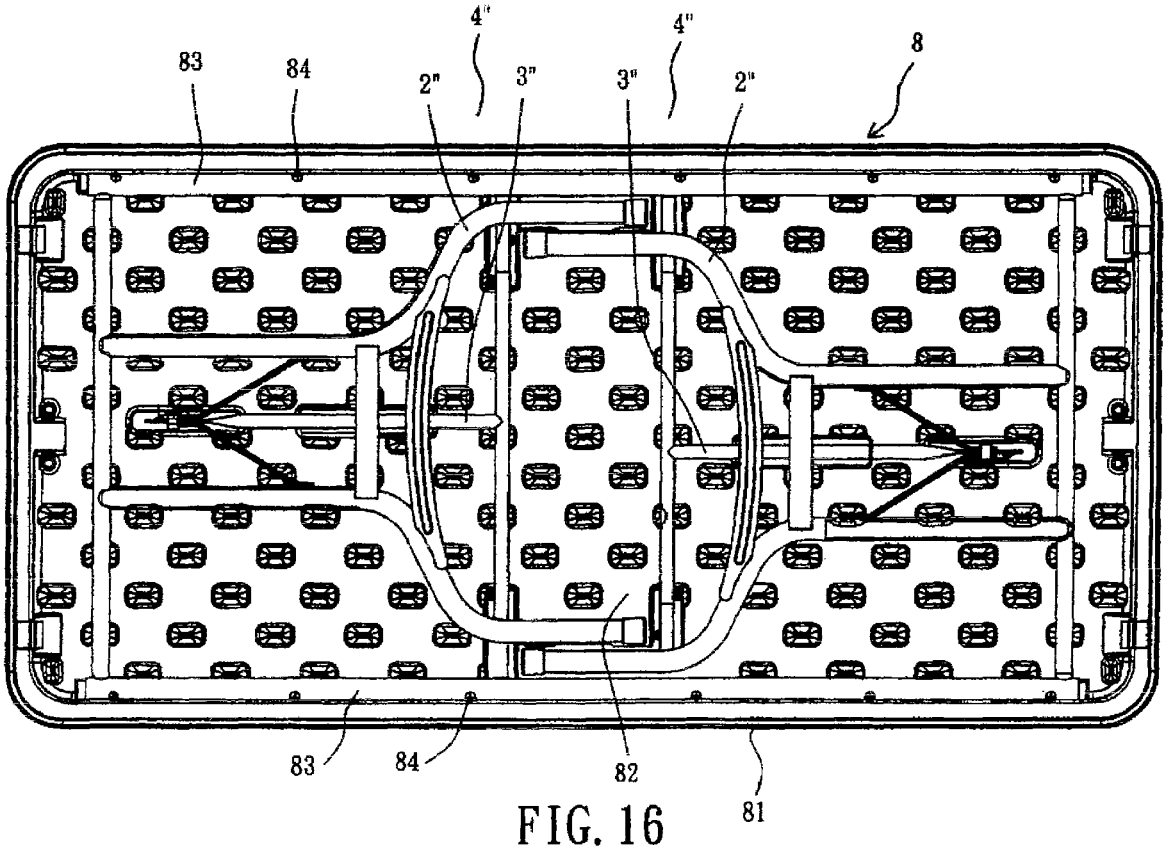
FIG. 16 is a plan folded view of the blow-molded table as shown in FIG. 14.

Referring to FIGS. 14-16, a blow-molded table 8 in accordance with another embodiment of the present invention is shown wherein the table board 81 has a length smaller than that of the table board 1. The bottom of the table board 81 is formed with a receiving space 82. The receiving space 82 of the table board 81 has two opposite sides each provided with a support tube 83 which is secured on the table board 81 by a plurality of screws 84. The receiving space 82 of the table board 81 is formed with a plurality of receiving recesses 85 for receiving the support stand 2" and the support member 3" of each of the support units 4" when being folded. In such a manner, the support bars 30" of the two support units 3" are spaced from each other as shown in FIG. 14, and the support stands 2" of the two support units 4" are arranged in a staggered manner as shown in FIGS. 15 and 16. In addition, the support stand 2" of each of the support units 4" has a narrower upper portion and a wider lower portion as shown in FIG. 15.

Figure 17H:
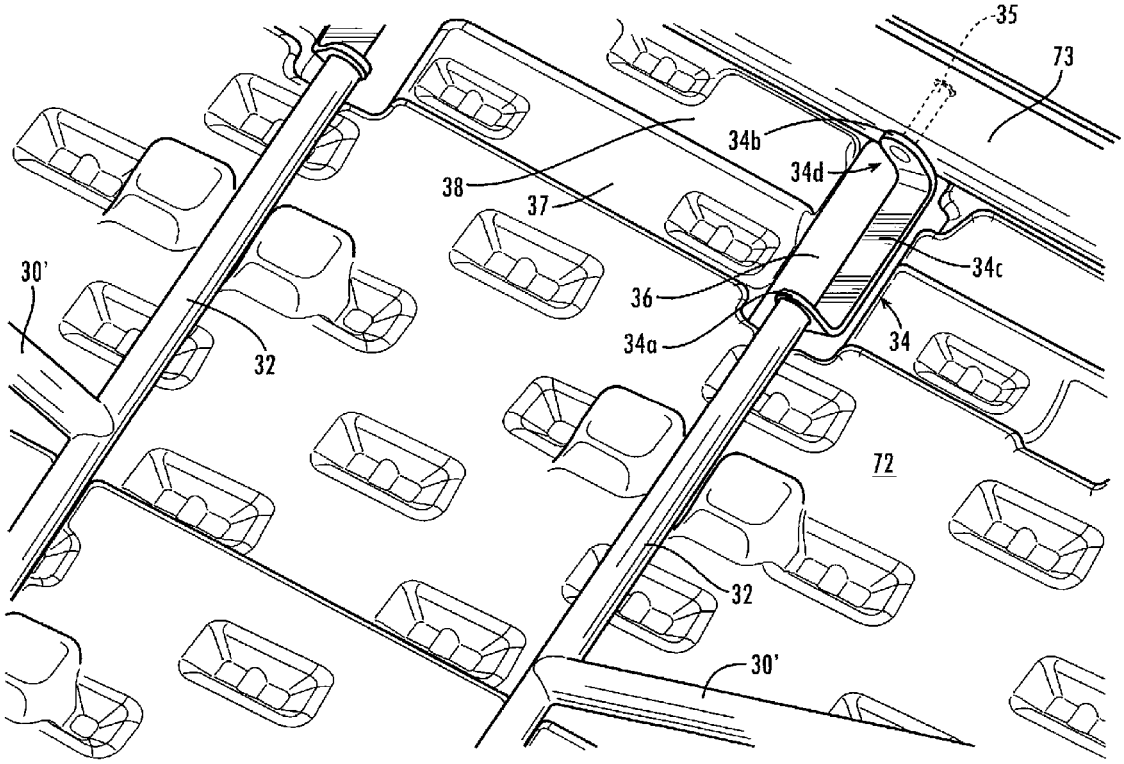
FIG. 17A depicts a perspective view of a cross brace on the bottom surface of the blow-molded table of FIGS. 11, 12 and 13 with legs extended.
FIG. 17B depicts a perspective view of a cross brace on the bottom surface of the blow-molded table of FIGS. 11, 12 and 13 with legs collapsed.
Figure 17B:
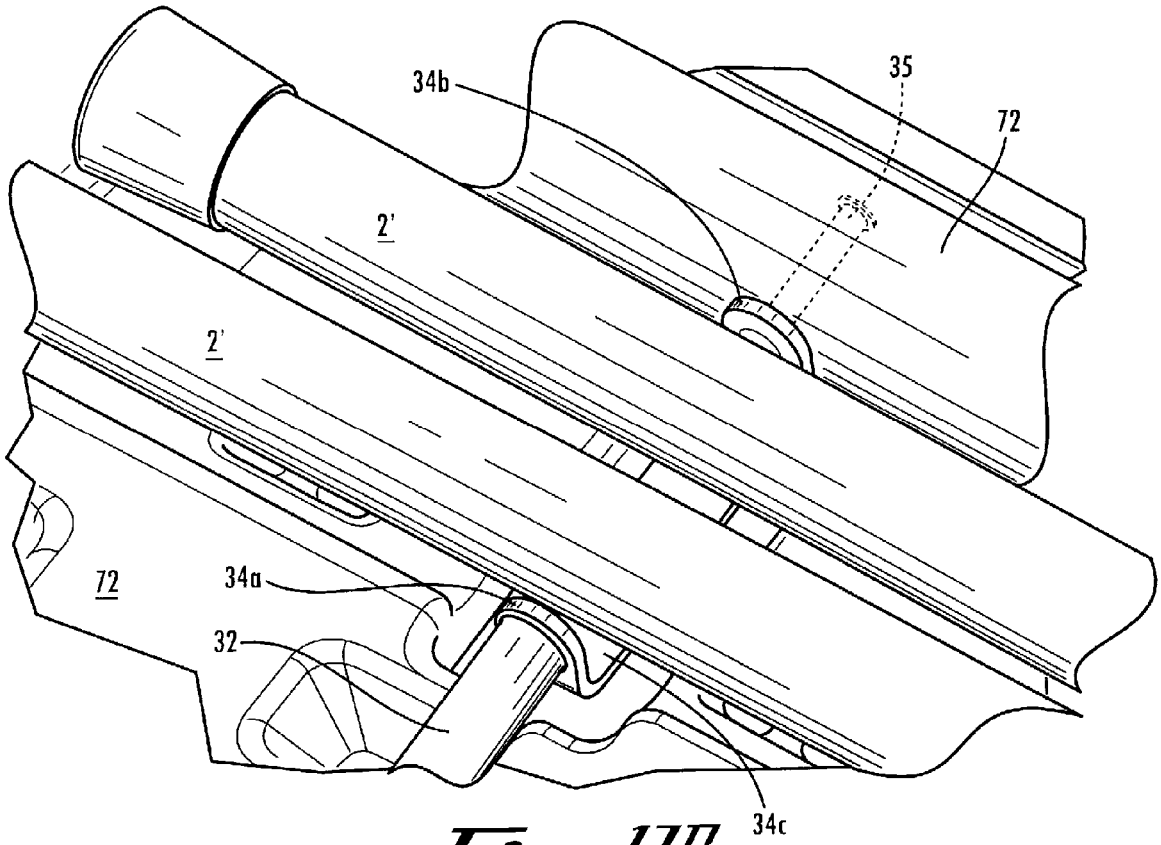

FIGS. 17A and 17B depict detailed views of the underside of the table shown in FIGS. 11, 12 and 13. In particular, these views show details of the U-shaped brackets 34 at opposing ends of the cross braces 32 that pivotally connect the support braces 30', also referred to above as the support bars 30', to the support tubes 73. As shown in FIG. 17B, when the legs 2' of the support stands are collapsed within the space 72 at the bottom surface of the table, the legs are substantially coplanar with the support tubes 73. The tubular portions of the cross braces 32 are also substantially coplanar with the support tubes 73. To preclude interference between the cross braces 32 and the legs 2', the U-shaped brackets 34 extend into recesses 36 in the bottom surface of the table top. This allows the U-shaped brackets 34 to receive the legs 2' at a position substantially coplanar with the tubular portions of the cross braces 32. Recesses 37 and 38 are also provided in the bottom surface of the table top for receiving the legs 2' when the legs 2' are collapsed. This configuration allows all the support structures to be received within the space 72 on the bottom surface of the table when the legs 2' are collapsed.

As shown in FIGS. 17A and 17B, the U-shaped brackets 34 include vertical end sections 34*a*-34*b* disposed at opposing ends of a horizontal central section 34*c*. In the preferred embodiment, the end section 34*a* is rigidly secured to the tubular portion of the cross brace 32, preferably by welding. An aperture 34*d* in the end section 34*b* receives a pivot pin 35 which preferably passes through the support tube 73. The pivot pin 35 attaches the U-shaped bracket 34 to the support tube 73 and allows the U-shaped bracket 34 to rotate about the longitudinal axis of the cross brace 32.

Figure 18A:
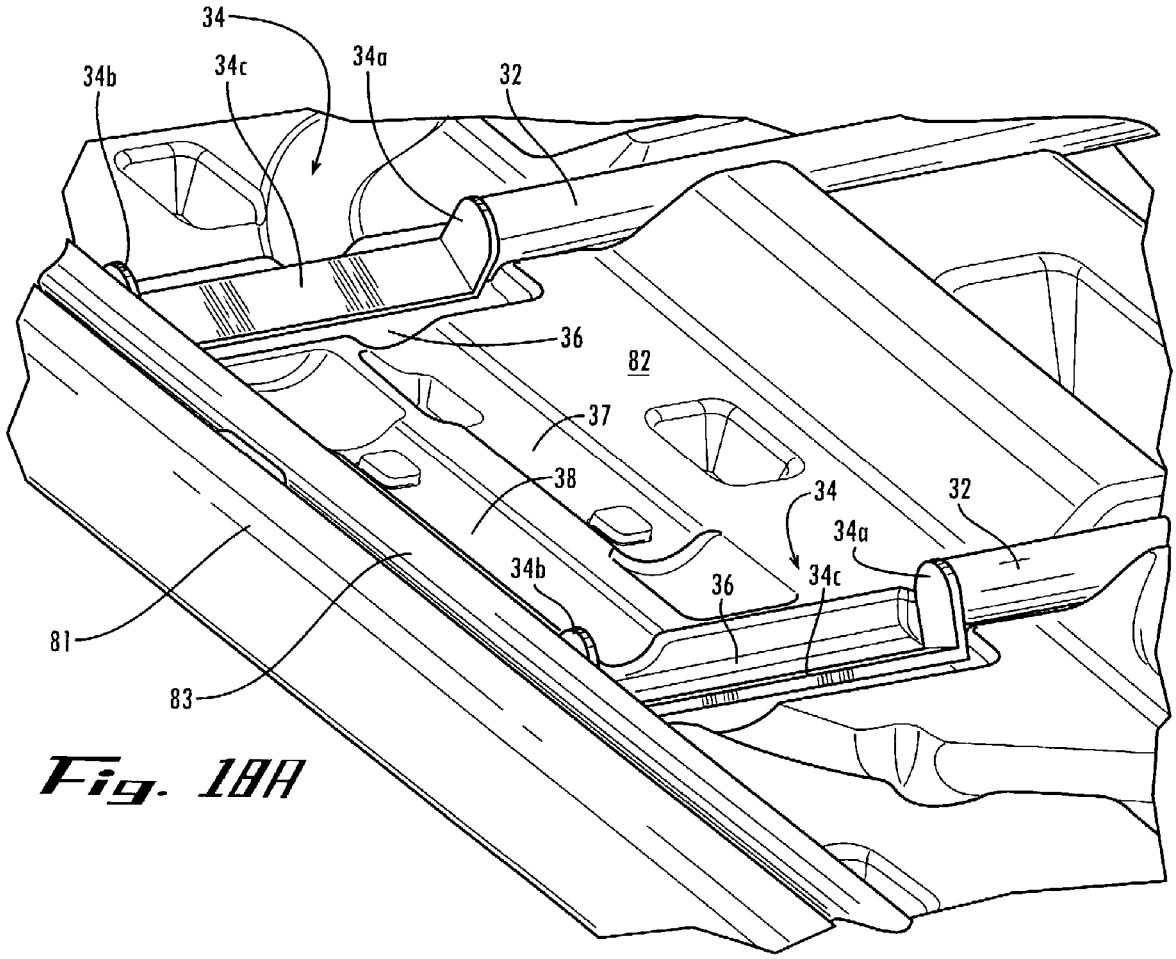
FIG. 18A depicts a perspective view of cross braces on the bottom surface of the blow-molded table of FIGS. 14, 15 and 16 with legs extended.
Figure 18B:
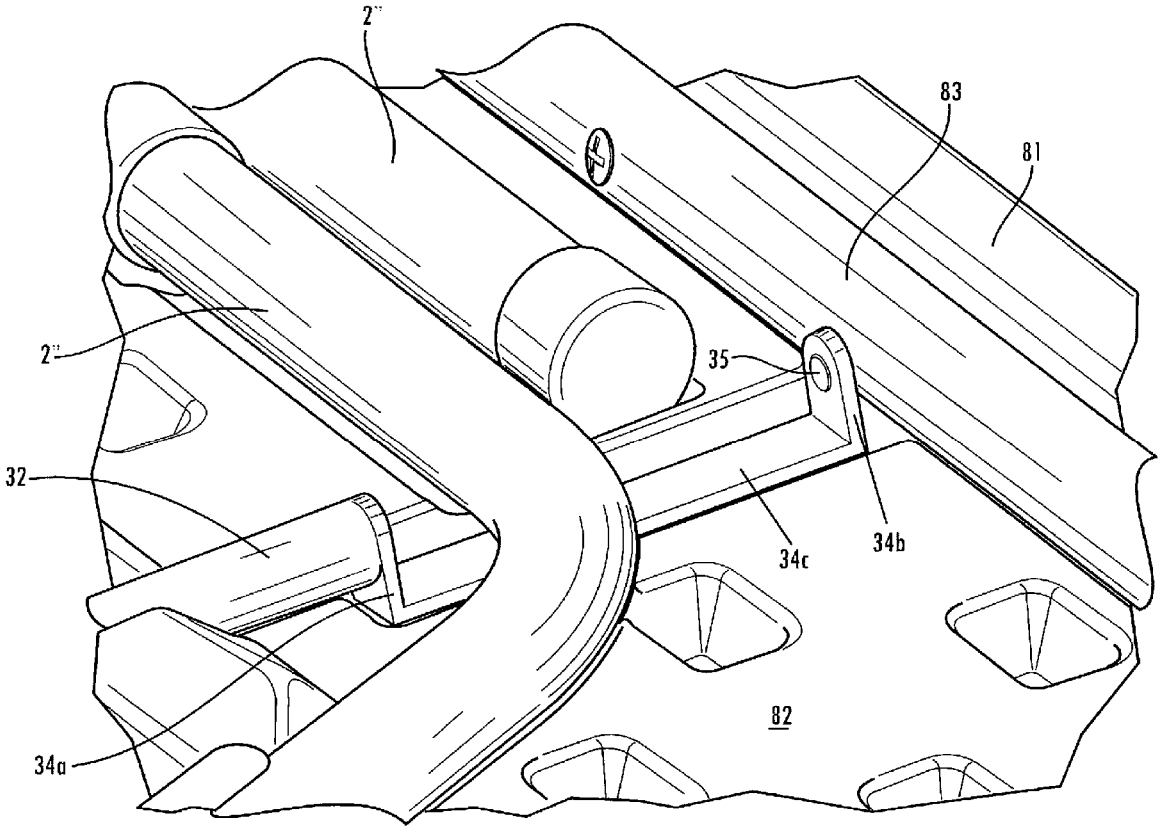
FIG. 18B depicts a perspective view of cross braces on a bottom surface of the blow-molded table of FIGS. 14, 15 and 16 with legs collapsed.

FIGS. 18A and 18B depict detailed views of the underside of the table shown in FIGS. 14, 15 and 16. In particular, these views show details of the U-shaped brackets 34 at opposing ends of the cross braces 32 that pivotally connect the braces 30" to the support tubes 83. As shown in FIG. 18B, when the support stand legs 2" are collapsed within the space 82 at the bottom surface of the table, the legs 2" are substantially coplanar with the support tubes 83. The tubular portions of the cross braces 32 are also substantially coplanar with the support tubes 83. To preclude interference between the cross braces 32 and the legs 2", the U-shaped brackets 34 extend into recesses 36 in the bottom surface of the table top. This allows the U-shaped brackets 34 to receive the legs 2" at a position substantially coplanar with the tubular portions of the cross braces 32. Recesses 37 and 38 are also provided in the bottom surface of the table top for receiving the legs 2" when the legs 2" are collapsed. This configuration allows all the support structures to be received within the space 82 on the bottom surface of the table when the legs 2" are collapsed.

As shown in FIGS. 18A and 18B, the U-shaped brackets 34 include vertical end sections 34*a*-34*b* disposed at opposing ends of a horizontal central section 34*c*. In the preferred embodiment, the end section 34*a* is rigidly secured to the tubular portion of the cross brace 32, preferably by welding. An aperture 34*d* in the end section 34*b* receives a pivot pin 35 which preferably passes through the support tube 83. The pivot pin 35 attaches the U-shaped bracket 34 to the support tube 83 and allows the U-shaped bracket 34 to rotate about the longitudinal axis of the cross brace 32.

Figure 19:
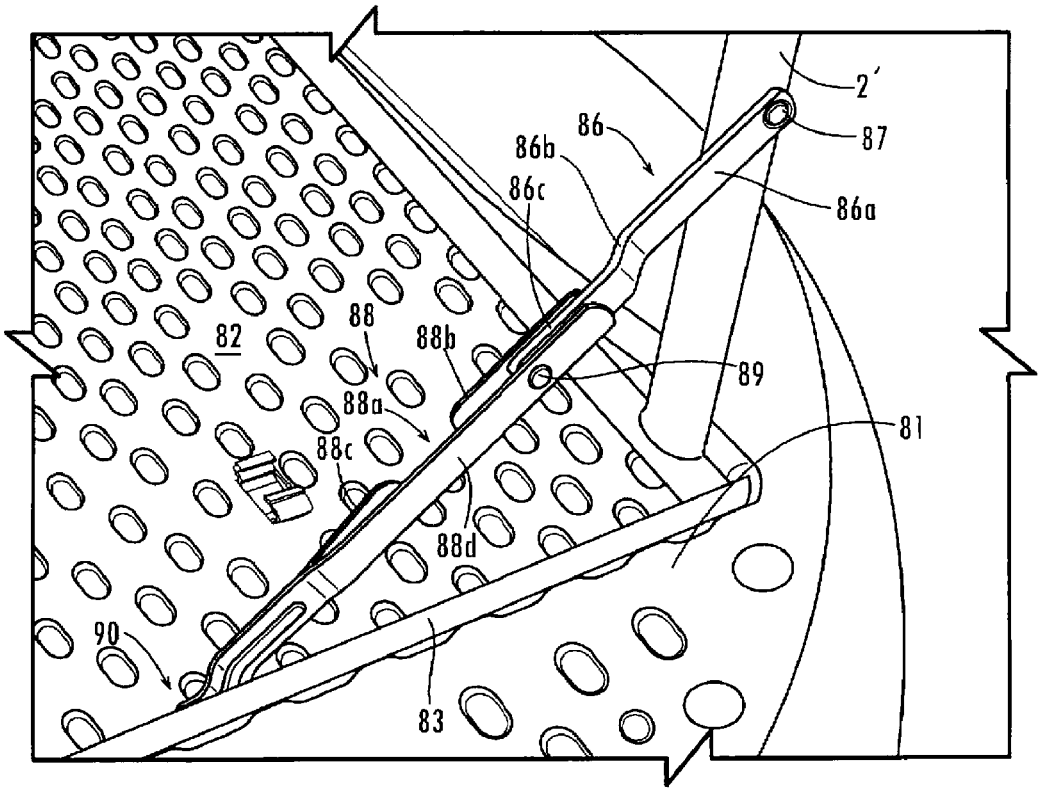
FIG. 19 depicts a perspective view of an articulated support brace in an extended position for supporting a table leg according to a preferred embodiment of the invention.
Figure 20:
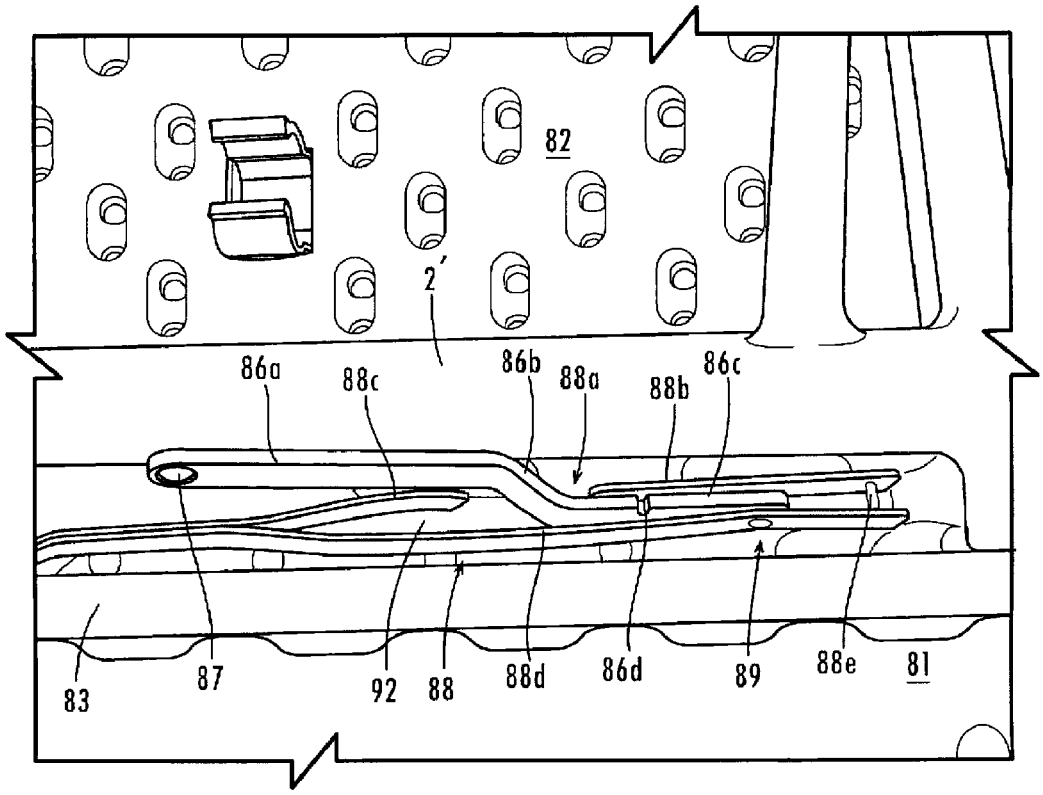
FIG. 20 depicts the articulated support brace of FIG. 19 in a collapsed position.
Figure 21:
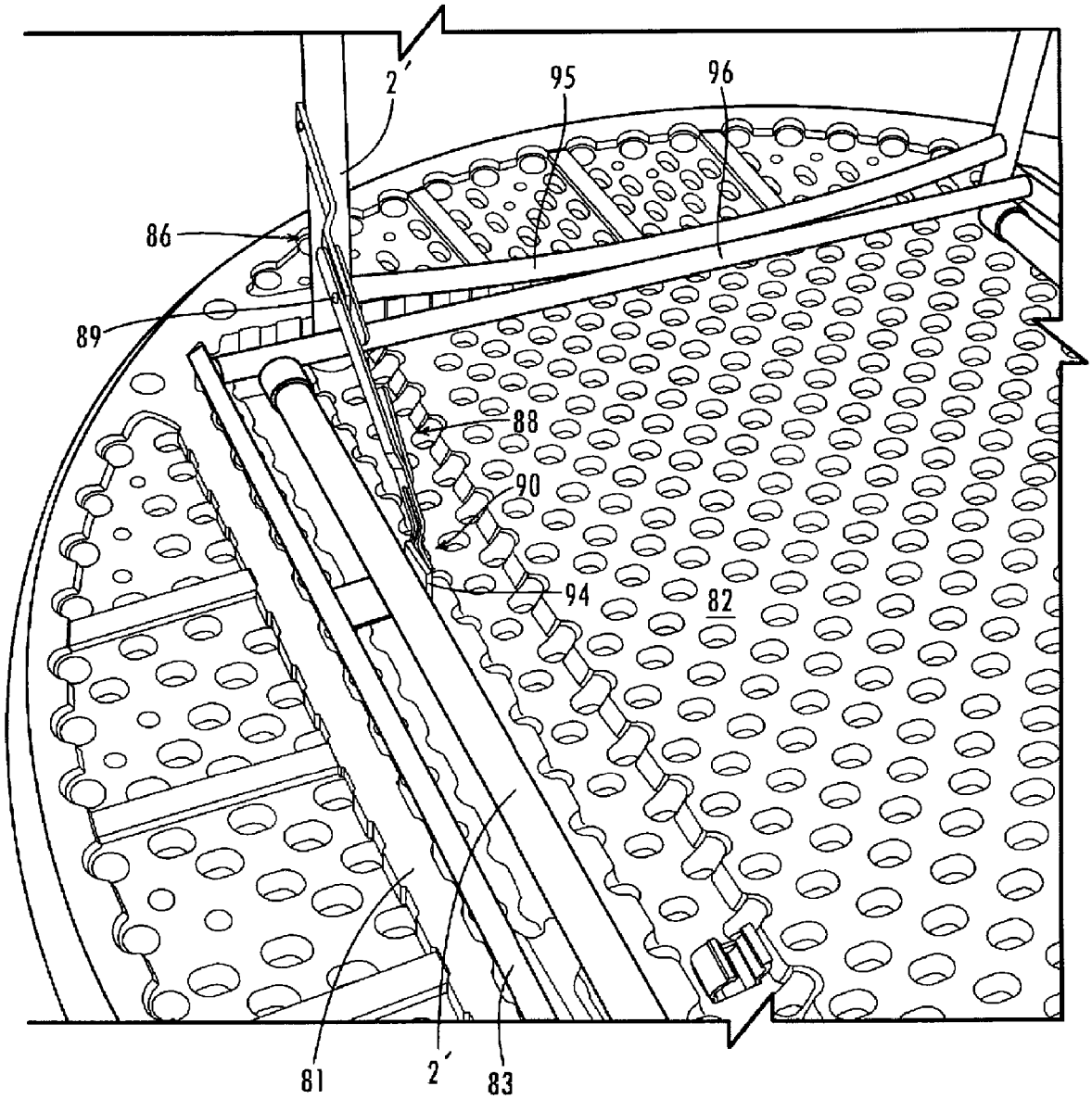
FIG. 21 depicts a perspective view of an articulated support brace in an extended position for supporting a table leg according to a preferred embodiment of the invention.
Figure 22:
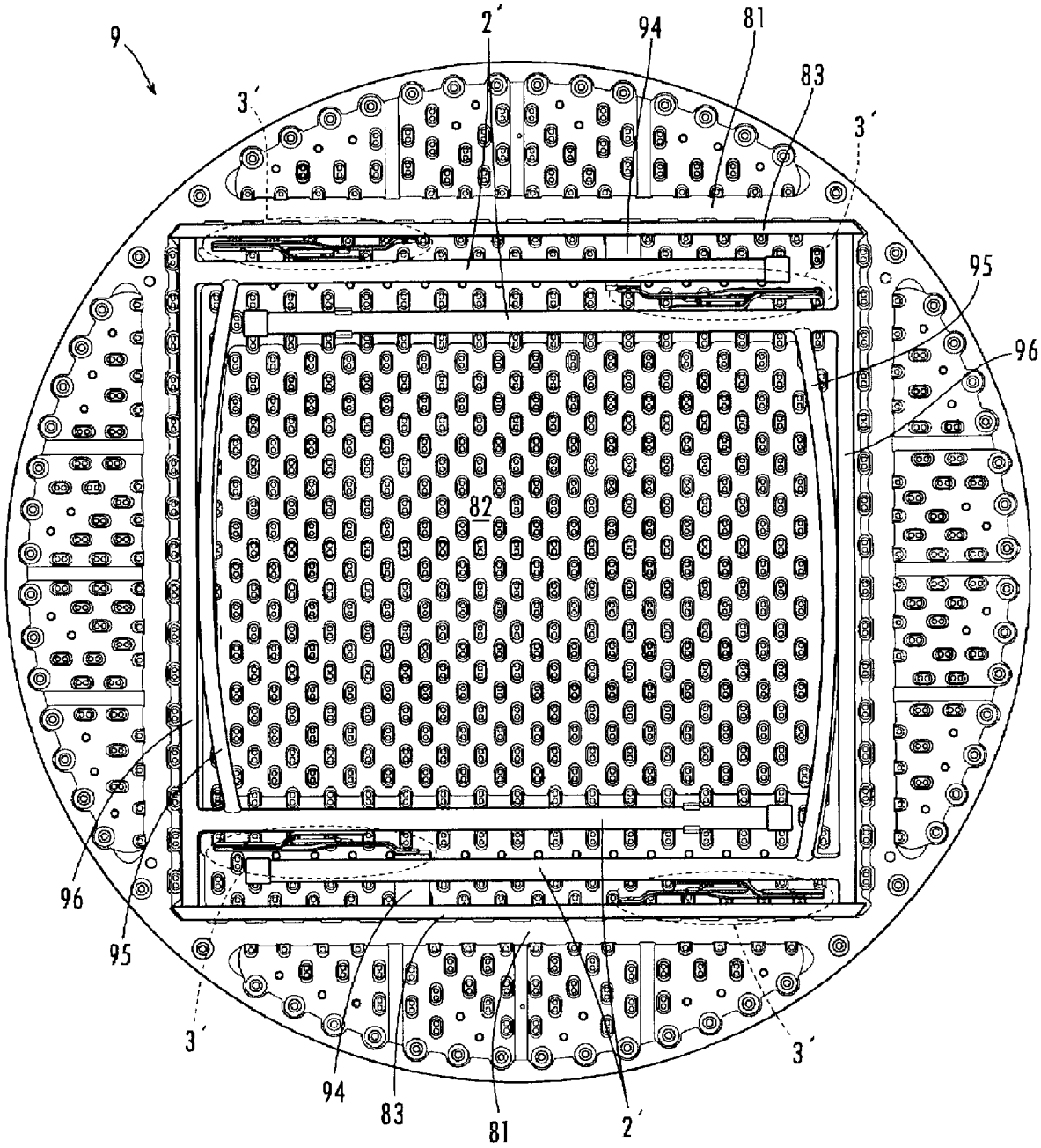
FIG. 22 depicts a bottom plan view of a circular table having collapsible legs according to a preferred embodiment of the invention.

FIG. 22 depicts a bottom view of a table 9 having a circular blow-molded table top with a collapsible leg structure. Molded into the bottom surface of the table top is a lip structure 81 to which is attached opposing frame rails 83. The frame rails 83 are preferably formed of metal and are attached to the lip 81 by fasteners such as screws. Pivotally connected to the opposing frame rails 83 are a pair of support bars 96 which are also preferably formed of metal. A pair of leg members 2' are attached to the support tubes, such as by welding, so that the legs 2' extend substantially perpendicularly from the support tubes 96. The pivotal connection of the support tubes 96 to the frame rails 83 allows the legs 2' to rotate between an upright position as shown in FIGS. 19 and 21 and a collapsed position as shown in FIGS. 20 and 22.

The table 9 includes an arcuate brace 95 extending between the opposing legs 2' to provide additional support to the legs 2'. The positioning of the brace 95 adjacent the support tube 96 keeps the brace 95 from interfering with the knees of a person seated at the table 9.

The table 9 includes four articulated support braces 3', each of which is connected at one end to an adjacent one of the four legs 2' and at the opposite end to an adjacent one of the frame rails 83. The braces 3' are shown in extended positions in FIGS. 19 and 21 and in folded positions in FIGS. 20 and 22. Each brace 3' includes an outer section 88 that is pivotally connected to the frame rail 83 by a pin fastener 90 and an inner section that is pivotally connected to the leg 2' by a pin fastener 87. The inner section 86 and the outer section 88 of each brace 3' are pivotally connected together by a pin fastener 89 to form an articulated joint. The braces 3' are preferably formed from metal, such as steel.

The inner section 86 of each brace 3' comprises a lower portion 86*a* that is pivotally connected to the adjacent leg 2', an upper portion 86*c* that is pivotally connected to the outer section 88 of the brace 3', and a dogleg portion 86*b* between the lower and upper portions. Due to the curvature of the dogleg portion 86*b*, the lower portion 86*a* is laterally offset from and parallel to the upper portion 86*c*.

In the preferred embodiment of the invention, the outer section 88 of each brace 3' is formed from a single piece of sheet metal that is folded to form an outer flange 88*d* on one side of the fold and an upper inner flange 88*c* and a lower inner flange 88*b* on the other side of the fold. A space 88*a* separates the upper inner flange 88*c* from the lower inner flange 88*b*. The upper portion 86*c* of the of the inner section 86 is sandwiched between the outer flange 88*d* and the lower inner flange 88*b* of the outer section 88. The pin fastener 89 passes through the lower inner flange 88*b* of the outer section 88, the upper portion 86*d* of the inner section 86 and the outer flange 88*d* of the outer section 88. A pin fastener 90 passes through the upper inner flange 88*c* and the outer flange 88*d* and into the adjacent frame rail 83 to pivotally connect the outer section 88 to the frame rail 83.

As shown in FIG. 20, when the brace 3' is in the folded position, the dogleg portion 86*b* of the inner section 86 of the brace 3' passes through the space 88*a*. When the brace 3' is in the extended position (FIGS. 19 and 21), a notch 86*d* in the upper portion 86*c* of the inner section 86 engages a stopper pin 88*e* disposed between the lower inner flange 88*b* and the outer flange 88*d* of the outer section 88. The stopper pin 88*e* prevents the inner section 86 from rotating past a parallel alignment with the outer section 88.

As shown in FIG. 22, when the legs 2' are in the collapsed position, one pair of the legs 2' is interdigitated with the opposing pair of legs 2'. In this configuration, the innermost leg 2' of each pair of legs is separated from the adjacent side rail 83 by the outermost leg 2' of the opposing pair of legs. The two support braces 3' connected to the two innermost legs 2' are referred to herein as inner braces, and the two braces 3' connected to the two outermost legs 2' are referred to herein as outer braces.

The outer section 88 of each inner brace 3' is pivotally connected to the adjacent side rail 83 by way of an extension bracket 94 that is preferably L-shaped. The extension bracket 94 includes a vertical portion that is pivotally connected to the outer section 88 of the inner brace 3' by the pivot fastener 90. A horizontal portion of the extension bracket 94 is securely fastened to the adjacent side rail 83, such as by welding. As shown in FIGS. 21 and 22, when the opposing pair of legs 2' are collapsed, one of the legs 2' lies between the vertical portion of the extension bracket 94 and the adjacent side rail 83. With this arrangement, when the legs 2' are in the collapsed position, the legs 2', support tubes 96, arcuate braces 95, articulated support braces 3' and side rails 83 are all substantially coplanar and disposed within the space 82 between the lips 81 of the table top. In this way, the table 9 occupies a very flat and compact envelop for stacking and storing.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

a blow-molded table top having an upper surface and a lower surface;

a pair of substantially parallel frame members attached on opposing sides of the table top adjacent the lower surface of the table top;

a first support stand and a second support stand, both pivotally attached to and between the frame members, the first and second support stands operable to be positioned in an upright position in which the first and second support stands are disposed substantially perpendicular to the lower surface of the table top and in a collapsed position in which the first and second support stands are disposed substantially parallel to the lower surface of the table top, each of the first and second support stands comprising opposing first and second leg members;

a first articulated support brace having an inner section pivotally connected to the first leg member of the first support stand and an outer section pivotally connected to an adjacent one of the frame members, the first support brace having an articulated joint disposed between its inner and outer sections whereby the first support brace is extended when the first support stand is in the upright position and the first support brace is folded when the first support stand is in the collapsed position;

a second articulated support brace having an inner section pivotally connected to the second leg member of the first support stand and an outer section pivotally connected to an adjacent one of the frame members, the second support brace having an articulated joint disposed between its inner and outer sections whereby the second support brace is extended when the first support stand is in the upright position and the second support brace is folded when the first support stand is in the collapsed position;

a third articulated support brace having an inner section pivotally connected to the first leg member of the second support stand and an outer section pivotally connected to an adjacent one of the frame members, the third support brace having an articulated joint disposed between its inner and outer sections whereby the third support brace is extended when the second support stand is in the upright position and the third support brace is folded when the second support stand is in the collapsed position; and a fourth articulated support brace having an inner section pivotally connected to the second leg member of the second support stand and an outer section pivotally connected to an adjacent one of the frame members, the fourth support brace having an articulated joint disposed between its inner and outer sections whereby the fourth support brace is extended when the second support stand is in the upright position and the fourth support brace is folded when the second support stand is in the collapsed position, wherein the inner section of each of the articulated support braces comprises:

a lower portion that is pivotally connected to the corresponding leg member;

an upper portion having a first aperture disposed at the articulated joint; and a dogleg portion disposed between the lower portion and the upper portion;

wherein the outer section of each of the articulated support braces comprises a single elongate piece of sheet metal folded to form an outer flange disposed on an outer side of the fold, the outer flange having a second aperture disposed at the articulated joint, and a lower inner flange disposed on an inner side of the fold, the lower inner flange having a third aperture substantially aligned with the second aperture in the outer flange, wherein the upper portion of the inner section of each of the articulated support braces is sandwiched between the outer flange and the lower inner flange of the outer section, and the first aperture of the upper portion is substantially aligned with the second aperture in the outer flange and third aperture in the lower inner flange, and wherein the articulated joint of each support brace comprises a first pivot fastener passing through the first, second and third apertures to pivotally connect the inner section to the outer section.

2. The collapsible table of claim 1 wherein, the outer section of each of the articulated support braces includes:

an upper inner flange disposed on the inner side of the fold; and a space between the upper inner flange and the lower inner flange, and the dogleg portion of the inner section passes Through the space between the upper inner flange and the lower inner flange when the support brace is in the folded position.

3. The collapsible table of claim 2 further comprising:

the outer section of each of the articulated support braces including:

a fourth aperture disposed in the outer flange where the outer section is pivotally connected to the adjacent frame member; and a fifth aperture disposed in the upper inner flange, the fifth aperture substantially aligned with the fourth aperture; and a second pivot fastener passing through the fourth and fifth apertures to pivotally connect the outer section to the adjacent frame member.

4. The collapsible table of claim 1 further comprising:

the outer section of each of the articulated support braces including a stopper pin disposed between the outer flange and the lower inner flange; and the inner section of each of the articulated support braces including a notch in the upper portion, wherein the stopper pin in the outer section engages the notch in the inner section to prevent the outer section from rotating substantially past a parallel alignment with the inner section when the articulated brace is in the extended position.

5. The collapsible table of claim 1 further comprising:

a first extension bracket disposed between the outer section of the first articulated support brace and the adjacent frame member, the first extension bracket having a horizontal section connected to the adjacent frame member and a vertical section extending substantially perpendicularly from the bottom surface of the table top, the horizontal section having sufficient width between the adjacent frame member and the vertical section to accommodate one of the leg members of the second support stand when the second support stand is in the collapsed position;

the outer section of the first articulated support brace being pivotally connected to the vertical section of the first extension bracket;

a second extension bracket disposed between the outer section of the third articulated support brace and the adjacent frame member, the second extension bracket having a horizontal section connected to the adjacent frame member and a vertical section extending substantially perpendicularly from the bottom surface of the table top, the horizontal section having sufficient width between the adjacent frame member and the vertical section to accommodate one of the leg members of the first support stand when the first support stand is in the collapsed position; and the outer section of the third articulated support brace being pivotally connected to the vertical section of the second extension bracket.

* * * * *

UNITED STATES PATENT AND TRADEMARK OFFICE

CERTIFICATE OF CORRECTION

PATENT NO. : 7,621,224 B2
APPLICATION NO. : 11/423547
DATED : November 24, 2009
INVENTOR(S) : Lin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 625 days.

Signed and Sealed this

Fourteenth Day of December, 2010

David J. Kappos

David J. Kappos
*Director of the United States Patent and Trademark Office*